US009908178B2

(12) United States Patent
Kim et al.

(10) Patent No.: US 9,908,178 B2
(45) Date of Patent: Mar. 6, 2018

(54) METHOD FOR PREPARING ULTRATHIN SILVER NANOWIRES, AND TRANSPARENT CONDUCTIVE ELECTRODE FILM PRODUCT THEREOF

(71) Applicant: KOOKMIN University Industry Academy Cooperation Foundation, Seoul (KR)

(72) Inventors: Jin Yeol Kim, Seoul (KR); Eun Jong Lee, Seoul (KR); Min Hwa Chang, Seoul (KR); Hyun Ah Cho, Koyang (KR); Youn Soo Kim, Seoul (KR)

(73) Assignee: KOOKMIN UNIVERSITY INDUSTRY ACADEMY COOPERATION FOUNDATION, Seoul (KR)

( * ) Notice: Subject to any disclaimer, the term of this patent is extended or adjusted under 35 U.S.C. 154(b) by 205 days.

(21) Appl. No.: 14/525,334

(22) Filed: Oct. 28, 2014

(65) Prior Publication Data

US 2016/0114395 A1 Apr. 28, 2016

(51) Int. Cl.
*B22F 1/00* (2006.01)
*H01B 1/12* (2006.01)
(Continued)

(52) U.S. Cl.
CPC ..... *B22F 9/20* (2013.01); *B22F 1/0025* (2013.01); *B22F 9/24* (2013.01); *C22C 5/06* (2013.01);
(Continued)

(58) Field of Classification Search
CPC ..... B22F 9/20; B22F 1/004; B22F 1/0044; H01B 1/124
(Continued)

(56) References Cited

U.S. PATENT DOCUMENTS

2008/0143906 A1* 6/2008 Allemand ..... B82Y 10/00 349/43
2011/0219913 A1* 9/2011 Suh ..... B22F 1/0025 75/343
(Continued)

FOREIGN PATENT DOCUMENTS

KR 10-1089299 12/2011
KR 10-2011-0072762 9/2013

OTHER PUBLICATIONS

U.S. Appl. No. 11/504,822, filed Mar. 29, 2007, Cambrios Technologies Corporation.
(Continued)

*Primary Examiner* — Mark Kopec
*Assistant Examiner* — Danny N Kang
(74) *Attorney, Agent, or Firm* — Adam Warwick Bell; Matthew Rupert Kaser

(57) ABSTRACT

Disclosed herein is a method for preparing ultrathin silver nanowires. It may comprise (a) dissolving a silver salt (Ag salt) and a capping agent in a reducing solvent to give a mixture solution; (b) adding a halide compound to the mixture solution to yield a silver seed; (c) heating the mixture solution and then allowing the heated mixture solution to grow ultrathin silver nanowires from the silver seed under a pressure in an inert gas atmosphere; and (d) cooling the mixture solution in which the ultrathin silver nanowires have grown, followed by purification and separation to obtain the ultrathin silver nanowires. The silver nanowires are restrained from growing in thickness under a certain pressure, so that they are 30 nm or less in thickness and have a narrow diameter distribution, which leads to an improvement in aspect ratio.

16 Claims, 14 Drawing Sheets

(51) Int. Cl.

| | |
|---|---|
| ***C22C 5/06*** | (2006.01) |
| ***C22B 3/00*** | (2006.01) |
| ***B22F 9/20*** | (2006.01) |
| ***B22F 9/24*** | (2006.01) |

(52) U.S. Cl.
CPC ..... *H01B 1/124* (2013.01); *B22F 1/0018* (2013.01); *B22F 2009/245* (2013.01)

(58) Field of Classification Search
USPC ..... 252/500, 514
See application file for complete search history.

(56) References Cited

U.S. PATENT DOCUMENTS

2012/0247275 A1* 10/2012 Yang ..... B22F 9/24
75/370
2012/0301741 A1* 11/2012 Zhang ..... B22F 1/0025
428/606
2013/0192423 A1* 8/2013 Yang ..... B22F 9/24
75/370

OTHER PUBLICATIONS

U.S. Appl. No. 11/871,721, filed Feb. 26, 2009, Cambrios Technologies Corporation.
U.S. Appl. No. 13/811,342, filed Oct. 17, 2013, The Industry and academic cooperation in Kongju national university.

* cited by examiner

METHOD FOR PREPARING ULTRATHIN SILVER NANOWIRES, AND TRANSPARENT CONDUCTIVE ELECTRODE FILM PRODUCT THEREOF

BACKGROUND OF THE INVENTION

Field of the Invention

The present invention relates to a method for preparing ultrathin silver nanowires, and for preparing a transparent, conductive electrode film based on the ultrathin nanowires. More particularly, the present invention relates to a method for preparing silver nanowires, having a diameter of 30 nm or less with a narrow diameter distribution and an aspect ratio of 300 or higher wherein, by such methods, the wires are restrained from growing beyond a certain thickness and are grown in a controlled way so as to provide a wire with an improved aspect ratio.

Description of the Related Art

Ambitious development has been ongoing in the electronic display device industry, with active research focused on cost reduction in thin film preparation and the flexibility, slimness and functionality of such thin films.

To gain a competitive edge, various industries concerning organic solar cells, and organic semiconductors, as well as flat panel displays (FPD) such as liquid crystal displays (LCD), plasma display panels (PDP) and electroluminescent displays, have developed functional materials that are thinner and more flexible than conventional materials, and which are combined to perform various complex functions. Therefore, there is a need needed for development of simpler techniques for preparing such functional materials.

Technologies for functional thin films are particularly widely applied to substrate electrode materials and organic conductors. Recently, film technology for flexible displays as well as organic semiconductors has attracted keen interest.

On the whole, transparent electrode materials refer to materials that are used as transparent electrodes in devices such as flat panel displays and solar cells. For use in such devices, transparent electrodes should have a visible light transmittance of 80% or higher, and be of high electrical conductivity, with a surface resistance of 100 Ω/□ (ohm/square) or less.

Currently, transparent electrodes are prepared mostly from metal oxides via sputtering. In recent years, conductive polymers or carbon nanotubes (CNTs) have been reported as materials of transparent electrodes.

However, these materials are observed to be lower in conductivity, higher in light absorbance, and poorer in chemical and thermal stability than the metal oxide indium tin oxide (ITO). To develop an alternative to ITO, active research has recently been directed toward transparent conductors composed of a random network of silver nanowires.

Silver (Ag) is known to have the highest electrical and thermal conductivity of all metals. When formed at the nano-scale, silver also exhibits excellent optical properties, such as high transmittance of visible light.

For use in the field of transparent electrode materials, silver nanowires should be thin with a high aspect ratio and small size deviation.

In regard to the synthesis of silver nanowires, a method for preparing silver nanowires using a metal catalyst is found in Korean Patent Application Unexamined Publication No. 10-2011-0072762 in which a precursor solution containing an Ag salt, an aqueous polymer, a metal halide with a standard reduction potential of −0.1 to 0.9 V as a metal catalyst, and a reducing solvent is heated to prepare silver (Ag) nanowires.

However, this method cannot restrain the growth of silver nanowires in a thickness direction, which leads to the impossibility of increasing the aspect ratio of the silver nanowires to a certain level. Thus, the conventional technique is improper for preparing silver nanowires to be used as a transparent electrode having a small diameter and excellent aspect ratio.

In addition, techniques relevant to silver nanowires are disclosed in U.S. patent application Ser. Nos. 11/504,822, and 11/871,721, which describes the preparation of silver nanowires using polyol methods.

Also, the prior art describes the synthesis of one-dimensional silver wires in a solution phase using a reducing solvent containing a silver precursor and ethylene glycol, and a capping agent containing polyvinylpyrrolidone (PVP).

Korean Patent No. 10-1089299 introduces the use of an ionic solution of imidazole halide in the polyol synthesis of silver nanowires with a diameter of 80 to 100 nm.

When synthesized using such conventional techniques, the diameter of silver nanowires becomes thick as they grow. Silver nanowires with large diameters are prone to light scattering, thus decreasing their light transmittance. A film formed with thick nanowires thus has poor light transmittance and high haze. Hence, many problems arise when the silver nanowires synthesized by the conventional methods are applied to transparent electrode films.

In conventional preparation processes, as described, silver nanowires tend to become shorter as they become thinner. There is therefore a need for a method of preparing silver nanowires having a high aspect ratio.

The following documents may be relevant and are incorporated by reference:

(Patent Document 001) Korea Patent Application Unexamined Publication No.: 10-2011-0072762 (issued on Feb. 2, 2012)

(Patent Document 002) Korean Patent No.: 10-1089299 (issued on May 27, 2010)

(Patent Document 003) U.S. patent application Ser. No. 11/871,721 (issued on Sep. 13, 2011)

(Patent Document 004) U.S. patent application Ser. No. 11/504,822 (issued on Dec. 31, 2013)

SUMMARY OF THE INVENTION

Accordingly, the present invention has been made keeping in mind the above problems occurring in the prior art, and an object of the present invention is to provide a method for preparing ultrathin silver nanowires by which the silver nanowires are restrained from growing in thickness under a certain conditions including specific pressures, so that they are 30 nm or less in diameter, with a narrow diameter distribution (a narrow variability of diameter), which leads to an improvement in aspect ratio.

The invention also encompasses a single wire or a population of wires made by the method of the invention. The diameter of the wire(s) of the invention in a sample made by the present methods of the invention may have, for example, an average diameter of 30 nm or less. A single wire made by the claimed invention may have a diameter of 30 nm or less. The diameter of the wire made by the present methods of the invention may be, for example, no more than 40 nm, no more than 35 nm, no more than 30 nm, no more than 25 nm, no more than 20 nm, no more than 15 nm, or no more than 10 nm. Likewise the average diameter of a wire in a sample population of wires made by the method of the invention may be, for example no more than 40 nm, no more than 35 nm, no more than 30 nm, no more than 25 nm, or no more than 20 nm. Merely as an example, the standard deviation of the diameter within a population may be, for example 2, 3, 4, 5, 7 or 10, although these examples are in no way meant to be restrictive to the claimed invention.

It is another object of the present invention to provide a transparent conductive electrode film that greatly improves optical properties, exhibiting a light transmittance of between 80% to 98% and a surface resistance of 5 to 150 ohm/□ ("Ω/sq"), and which thus can find applications in various fields including organic solar cells, organic semiconductors and flexible display device or film-type display device.

In certain embodiments and examples, the transparent conductive electrode film may exhibit a light transmittance of, for example, at least 50%, at least 60%, at least 70%, at least 80%, at least 90%, at least 95%, or at least 98%. The surface resistance of the transparent conductive electrode film may be, for example, 3 to 1000 ohm/□ ("Ω/sq"), or in other embodiments, for example 5 to 1000 ohm/□, 5 to 500 ohm/□, 5 to 250 ohm/□ or 5 to 150 ohm/□, or, for example less than 150. Less than 100, less than 50 or less than 25 150 ohm/□.

In accordance with an aspect thereof, the present invention provides a method for preparing ultrathin silver nanowires, comprising: (a) dissolving a silver salt (Ag salt) and a capping agent in a reducing solvent to give a mixture solution; (b) adding a halide compound (a compound of fluorine, chlorine, bromine, iodine or astatine) to the mixture solution to yield a silver seed; (c) heating the mixture solution and then allowing the heated mixture solution to grow ultrathin silver nanowires from the silver seed under pressure (i.e., pressure greater than atmospheric pressure, e.g., greater than 1 bar) in an inert gas atmosphere; and (d) cooling the mixture solution in which the ultrathin silver nanowires have grown, followed by purification and separation to obtain the ultrathin silver nanowires.

In accordance with another aspect thereof, the present invention provides a method for preparing ultrathin silver nanowires, comprising: 1) dissolving a magnetic ionic liquid containing tetrachloroferrate, and a capping agent in a reducing solvent to give a mixture solution; 2) adding a silver salt to the mixture solution to yield a silver seed; 3) heating the mixture solution and then allowing the heated mixture solution to grow ultrathin silver nanowires from the silver seed under a pressure in an inert gas atmosphere; and 4) cooling the mixture solution in which the ultrathin silver nanowires have grown, followed by purification and separation to obtain the ultrathin silver nanowires.

In accordance with a further aspect thereof, the present invention provides ultrathin silver nanowires prepared using the same, having a diameter of 10 to 30 nm.

In accordance with still another aspect thereof, the present invention provides a transparent conductive electrode film, comprising the ultrathin silver nanowires.

In accordance with a still further aspect thereof, the present invention provides a method for preparing a transparent conductive electrode film, comprising: preparing ultrathin silver nanowires using the method; and dispersing or hybridizing the ultrathin silver nanowires with a one-dimensional polymer conductor to form a two-dimensional film consisting of a ultrathin silver nanowires/one-dimensional polymer conductor hybrid.

In the methods for preparing ultrathin silver nanowires according to the present invention, a certain pressure is applied to a mixture solution to restrain silver seeds from growing in thickness, whereby the ultrathin silver nanowires have a diameter of 30 nm or less and an improved aspect ratio.

In addition, the transparent, conductive electrode film based on the ultrathin silver nanowires has a light transmittance of 80% to 98%, and a surface resistance of 5 to 150 ohm/□.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

All documents referred to herein are fully incorporated by reference.

With reference to the accompanying drawings, the present invention will be described in detail herein below. However, in the following description of the invention, if the related known functions or specific instructions on configuring the gist of the present invention unnecessarily obscure the gist of the invention, the detailed description thereof will be omitted.

Reference will now be made in detail to various embodiments of the present invention, specific examples of which are illustrated in the accompanying drawings and described below, since the embodiments of the present invention can be variously modified in many different forms. While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Figure 1:
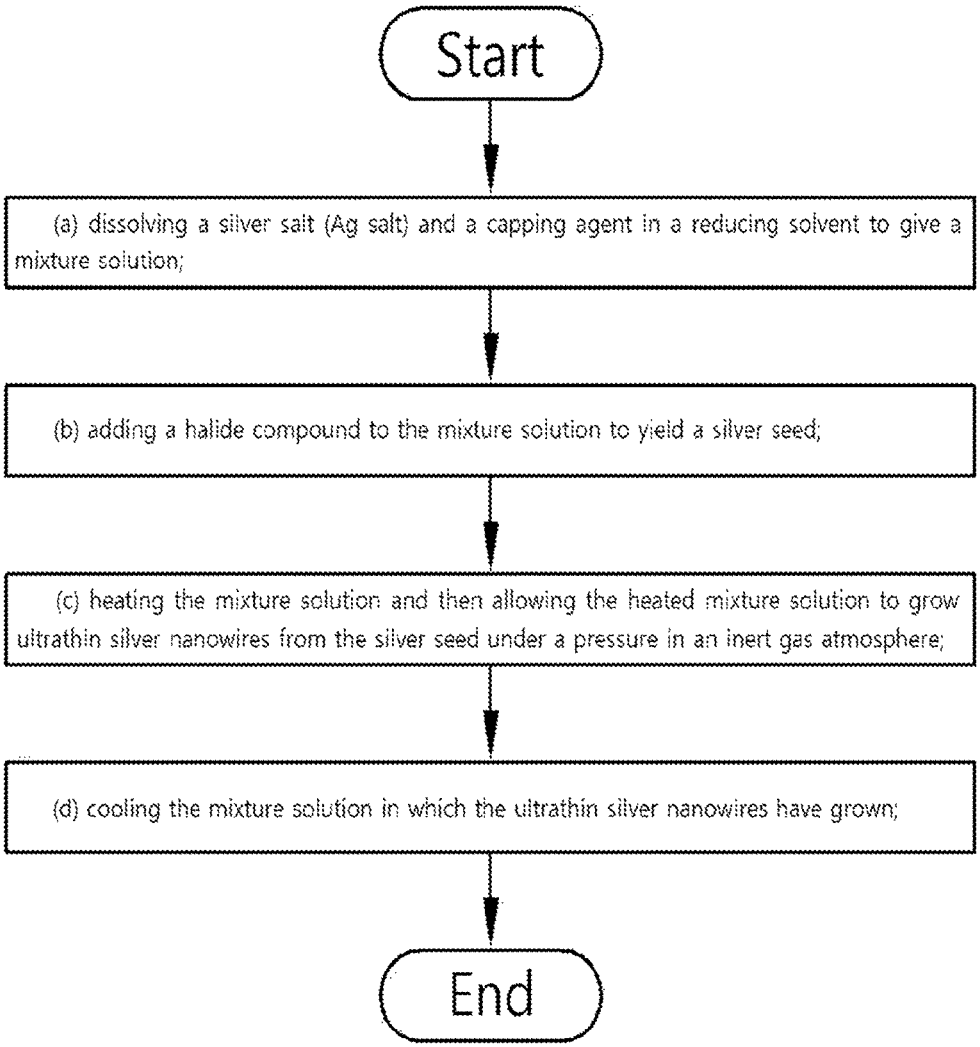
FIG. 1 is a flow chart describing a method for preparing ultrathin silver nanowires in accordance with an embodiment of the present invention.

FIG. 1 is a flow chart describing a method for preparing ultrathin silver nanowires in accordance with an embodiment of the present invention.

As shown in FIG. 1, the method for preparing ultrathin silver nanowires in accordance with the present invention comprises (a) dissolving a silver salt (Ag salt) and a capping agent in a reducing solvent to give a mixture solution, (b) adding a halide compound to the mixture solution to yield a silver seed, (c) heating the mixture solution and then allowing the heated mixture solution to grow ultrathin silver nanowires from the silver seed under a pressure in an inert gas atmosphere, and (d) cooling the mixture solution in which the ultrathin silver nanowires have grown, followed by purification and separation to obtain the ultrathin silver nanowires.

In greater detail, step (a) is to prepare a mixture solution by dissolving an Ag salt and a capping agent in a reducing solvent.

First, an Ag salt and a capping agent are dissolved in a solvent to give a mixture solution. The solvent may be a reducing solvent.

Examples of the Ag salt include silver nitrate ($AgNO3$), silver acetate ($AgO2CCH3$) and silver perchlorate ($AgClO4$), with preference for silver nitrate.

The capping agent may be used in an amount 1.50 to 3.50 mol per mole of the Ag salt, and may be polyvinylpyrrolidone (PVP), polyvinylalcohol (PVA), cetyltrimethyl ammonium bromide (CTAB), cetyltrimethyl ammonium chloride (CTAC), polyacrylamide (PAA), or a combination thereof.

Featuring reductive properties, the solvent may have two or more hydroxyl groups (—OH), that is, may be a polyol examples of which include ethylene glycol, 1,2-propylene glycol, 1,3-propylene glycol, glycerin, glycerol, glucose, and a combination thereof.

The reducing solvent is used in an amount sufficient to ensure that silver seeds formed as the silver salt is reduced in the presence of the capping agent in the reducing solvent are dispersed by the capping agent.

In step (b), a halide compound is added to the mixture solution to yield silver seeds.

The halide compound used in this step may be a metal halide or an organic halide. The metal halide may be selected from the group consisting of sodium chloride ($NaCl$), potassium bromide ($KBr$), potassium iodide ($KI$), iron trichloride ($FeCl3$), platinum trichloride ($PtCl3$), gold trichloride ($AuCl3$), and a combination thereof, and may be used in an amount of 0.08 to 0.20 mol per mole of the silver salt.

On the other hand, the organic halide may be selected from the group consisting of tetrabutylammonium chloride, tetrahexyl ammonium chloride, tetrapropylammonium chloride, tetrabutylammonium bromide, tetrahexyl ammonium bromide, tetrapropylammonium bromide, tetrabutylphosphonium bromide, and a combination thereof, and may be used in an amount of 0.05 to 0.30 mol per mole of the silver salt.

Herein, the solvent in which the metal halide or the organic halide is dissolved, is used in such an amount that halogen ions and metal or organic ions dissociated from the metal halide or the organic halide are sufficiently distant from each other so as not to form precipitates. After the halide compound is added, it induces the formation of silver seeds.

In step (c), the mixture solution is heated, after which ultrathin silver nanowires grow from the silver seeds under a pressure in an inert gas atmosphere. In this regard, the mixture solution may be heated at 120 to 180° C.

In an inert gas atmosphere, a pressure is applied to the heated mixture solution to grow ultrathin silver nanowires from the silver seeds. The pressure may exceed one atmospheric pressure, and may preferably on the order of 50 to 500 psi (pounds per square inch).

Step (d) is to acquire the ultrathin silver nanowires by cooling the mixture solution, and then through purification and separation.

First, the mixture solution in which ultrathin silver nanowires have grown is cooled, for example, 4 to 25° C.

Subsequently, the cooled mixture solution is purified and separated to obtain ultrathin silver nanowires. The purification may be carried out using a non-polar solvent such as acetone or tetratetrahydrofuran. The aggregation of the capping agent adsorbed onto the ultrathin silver nanowires induces the ultrathin silver nanowires to precipitate in the solution. Only the precipitate is taken, and dispersed in distilled water. In this regard, unreacted materials that did not participate in the formation of ultrathin silver nanowires are present, together with various additives, in the supernatant.

In addition, the precipitate contains ultrathin silver nanowires, and metal particles that were not removed in the purification step. Thus, when the precipitate is dispersed in distilled water, and further added with a suitable amount of acetone, the ultrathin silver nanowires having a high specific gravity precipitate, whereas metal particles having a small specific gravity remain in the supernatant. In this way, the capping agent adsorbed onto the ultrathin silver nanowires can be removed.

After the purification and separation process is repeated, precipitates of the ultrathin silver nanowires alone are withdrawn. In this regard, a proper amount of a dispersant may be added to prevent the re-aggregation of the ultrathin silver nanowires.

The ultrathin silver nanowires that are finally obtained may have a diameter of 30 nm or less, with an aspect ratio of 300 or higher.

Figure 2:
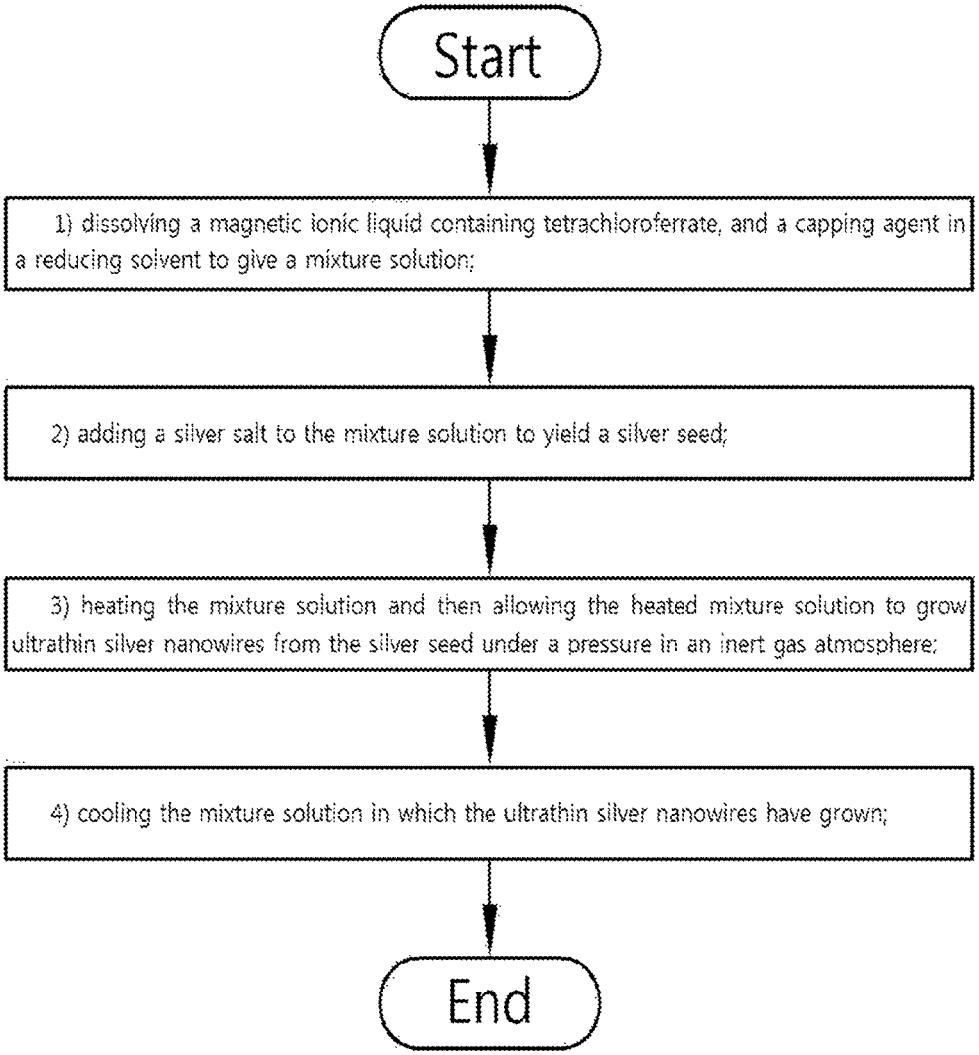
FIG. 2 is a flow chart describing a method for preparing ultrathin silver nanowires in accordance with another embodiment of the present invention.

FIG. 2 is a flow chart describing a method for preparing ultrathin silver nanowires in accordance with another embodiment of the present invention.

As shown in FIG. 2, a method for preparing ultrathin silver nanowires in accordance with another embodiment of the present invention comprises 1) dissolving a magnetic ionic liquid containing tetrachloroferrate, and a capping agent in a reducing solvent to give a mixture solution, 2) adding a silver salt to the mixture solution to yield a silver seed, 3) heating the mixture solution and then allowing the heated mixture solution to grow ultrathin silver nanowires from the silver seed under a pressure in an inert gas atmosphere, and 4) cooling the mixture solution in which the ultrathin silver nanowires have grown, followed by purification and separation to obtain the ultrathin silver nanowires.

In more detail, step 1) is to prepare a mixture solution by dissolving a magnetic ionic liquid containing tetrachloroferrate, and a capping agent in a reducing solvent.

First, a magnetic ionic liquid containing tetrachloroferrate, and a capping agent are dissolved in a solvent to give a mixture solution. The solvent may be a reducing solvent. The magnetic ionic liquid is composed of at least one compound represented by the following Chemical Formula 1, with tetrachloroferrate (FeCl4) as an anionic ion. The solvent is preferably used in an amount of 0.05 to 0.30 mol per mole of silver salt.

In this step, a halide compound that is different from the tetrachloroferrate may be further added to the magnetic ionic liquid. The halide compound may be a metal halide or an organic halide.

Herein, the halide compound added in this step may be a metal halide or an organic halide.

The metal halide may be at least one selected from the group consisting of sodium chloride (NaCl), potassium bromide (KBr), potassium iodide (KI), iron trichloride (FeCl3), platinum trichloride (PtCl3), and gold trichloride (AuCl3), and may be used in an amount of 0.08 to 0.20 mol per moles of silver salt.

The organic halide may be at least one selected from the group consisting of tetrahexyl ammonium chloride, tetrapropylammonium chloride, and tetrabutylammonium chloride, and may be used in an amount of 0.05 to 0.30 mol per mole of silver salt.

When containing bromine ions, the organic halide may be selected from the group consisting of tetrabutylammonium bromide, tetrahexyl ammonium bromide, tetrapropylammonium bromide, tetrabutylphosphonium bromide, 1-ethyl-3-methyl-imidazolnium bromide, 1-butyl-3-methyl-imidazolinium bromide, and a combination thereof, and may be used in an amount of 0.2 to 2.50 mol per mole of the magnetic ion liquid.

In addition, the same description of composition and amount as in the foregoing method may be applied to the capping agent and the reducing solvent.

The magnetic ionic liquid is sensitive to magnetism, and varies in physicochemical properties depending on the combination of cationic and anionic ions. Highly compatible with both the capping agent and the reducing solvent, the magnetic ionic liquid forms micelles in a polyol solvent, thereby controlling the extent of growth of the silver nanoparticles and wires, which leads to the growth of silver nanoparticles in the form of one-dimensional wires.

Further, the magnetic ionic liquid may contain tetrachloroferrate (FeCl4) as an anionic ion based on the ionic liquid composed of the compound represented by the following Chemical Formula 1. This magnetic ion liquid may be selected from the group consisting of 1-butyl-3-methyl-imidazolinium tetrachloroferrate, 1-ethyl-3-methyl-imidazolinium tetrachloroferrate, 1-propyl-3-methyl-imidazolinium tetrachloroferrate, and a combination thereof.

[Chemical Formula 1]

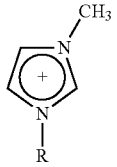

(wherein R is hydrogen, an alkyl of 1 to 15 carbon atoms, or an aromatic group).

In the method for preparing silver nanowires of the present invention, the magnetic ionic liquid may preferably be used in an amount of 0.05 to 0.30 mol per mole of the silver salt.

Herein, the solvent in which the metal halide or the organic halide is dissolved, is used in such an amount that halogen ions and metal or organic ions dissociated from the metal halide or the organic halide are sufficiently distant from each other so as not to form precipitates.

Step 2) is to yield silver seeds by adding a silver salt (Ag salt) to the mixture solution.

The silver (Ag) salt used in this step may be the same in chemical composition as is described in the foregoing method of preparing ultrathin silver nanowires.

In step 3), ultrathin silver nanowires are allowed to grow from the silver seed by heating the mixture solution and then applying a pressure to the mixture solution in an inert gas atmosphere.

First, the mixture solution containing the silver seed is heated to, for example, 160 to 180° C., and preferably to 170° C.

Then, a pressure of 100 psi or greater is applied to the heated mixture solution in an inert gas atmosphere to allow ultrathin silver nanowires to grow from the silver seed. Here, the pressure applied to the mixture solution may exceed one atmospheric pressure, and may preferably be on the order of 100 to 1,500 psi (pounds per square inch).

Step 4) is to acquire the ultrathin silver nanowires by cooling the mixture solution, and then through purification and separation.

The ultrathin silver nanowires can be acquired by carrying out this step in the same condition as in the foregoing preparing method.

The ultrathin silver nanowires that are finally obtained may have a diameter of 30 nm or less and an aspect ratio of 500 or more. More preferably, the ultrathin silver nanowires have a diameter of 20 nm or less.

As described above, the preparing methods of ultrathin silver nanowires in accordance with the present invention feature the application of a certain pressure during the growth of silver nanowires to restrain the widthwise growth, so that the silver nanowires can have an improved aspect ratio and a narrow distribution of diameters.

The ultrathin silver nanowires according to the present invention have a diameter of 30 nm or less and an aspect ratio of 300 or more, and can be prepared using the methods of the present invention.

A two-dimensional thin film or sheet prepared by transcribing the ultrathin silver nanowires onto PET (polyethylene terephthalate) exhibits a light transmittance of 80% to 98%, meets necessary electrical properties, such as a surface resistance of 5 ohm/□ to 150 ohm/□ and effectively reduces haze value.

Because of its a thickness of submicrons, the two-dimensional film or sheet can be optically transparent conductive films when the ultrathin silver nanowires are applied thereto. In this regard, the preparation of transparent conductive films using a network of anisotropic conductive nanostructures, such as metal nanowires, is already known in the art.

Also, the present invention addresses a method for preparing a transparent, conductive electrode film, comprising dispersing or hybridizing the ultrathin silver nanowires with a one-dimensional polymer conductor to form a composite film. In this regard, the ultrathin silver nanowires are hybridized with the polymer conductor during transition through electron passages. Examples of the one-dimensional polymer conductor useful in the formation of the film include polypyrrole, polythiophene, polyaniline, polythiol, and derivatives thereof, with preference for polythiol derivatives, and the polymer conductor may be contained in an amount of 10 weight % or more in the transparent, conductive film.

The method for preparing a transparent, conductive electrode film in accordance with the present invention is characterized in that a continuous conductive film is established between the ultrathin silver nanowires and a chain of the one-dimensional polymer conductor. Having such a structure, the transparent, conductive electrode film of the present invention retains a light transmittance of 80 to 98%, and exhibits a surface resistance of 5 ohm/□ to 150 ohm/□, both of which are improved by at least 5% each, compared to the light transmittance and the electrical properties obtained in the two-dimensional thins film composed of the ultrathin silver nanowires alone.

In the method for preparing a transparent, conductive electrode film according to the present invention, first, ultrathin silver nanowires are prepared using the method described above.

Then, the ultrathin silver nanowires thus obtained are surface activated in a liquid phase, and the surface-activated ultrathin silver nanowires are dispersed or hybridized with a one-dimensional polymer conductor to give a two-dimensional hybrid film of ultrathin silver nanowires-one-dimensional polymer conductor, followed by applying the hybrid film to a substrate film.

In one embodiment of the present invention, the two-dimensional hybrid film contains the ultrathin silver nanowires in an amount of at least 10 weight %.

For use in the present invention, the one-dimensional polymer conductor may be a conjugated polymer having a heterocyclic structure represented by the following Chemical Formula 2. The ultrathin silver nanowires have a diameter of 30 nm or less, and are dispersed with a distance of at least 100 nm therebetween when hybridized with the one-dimensional polymer conductor.

[Chemical Formula 2]

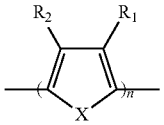

Figure 3:
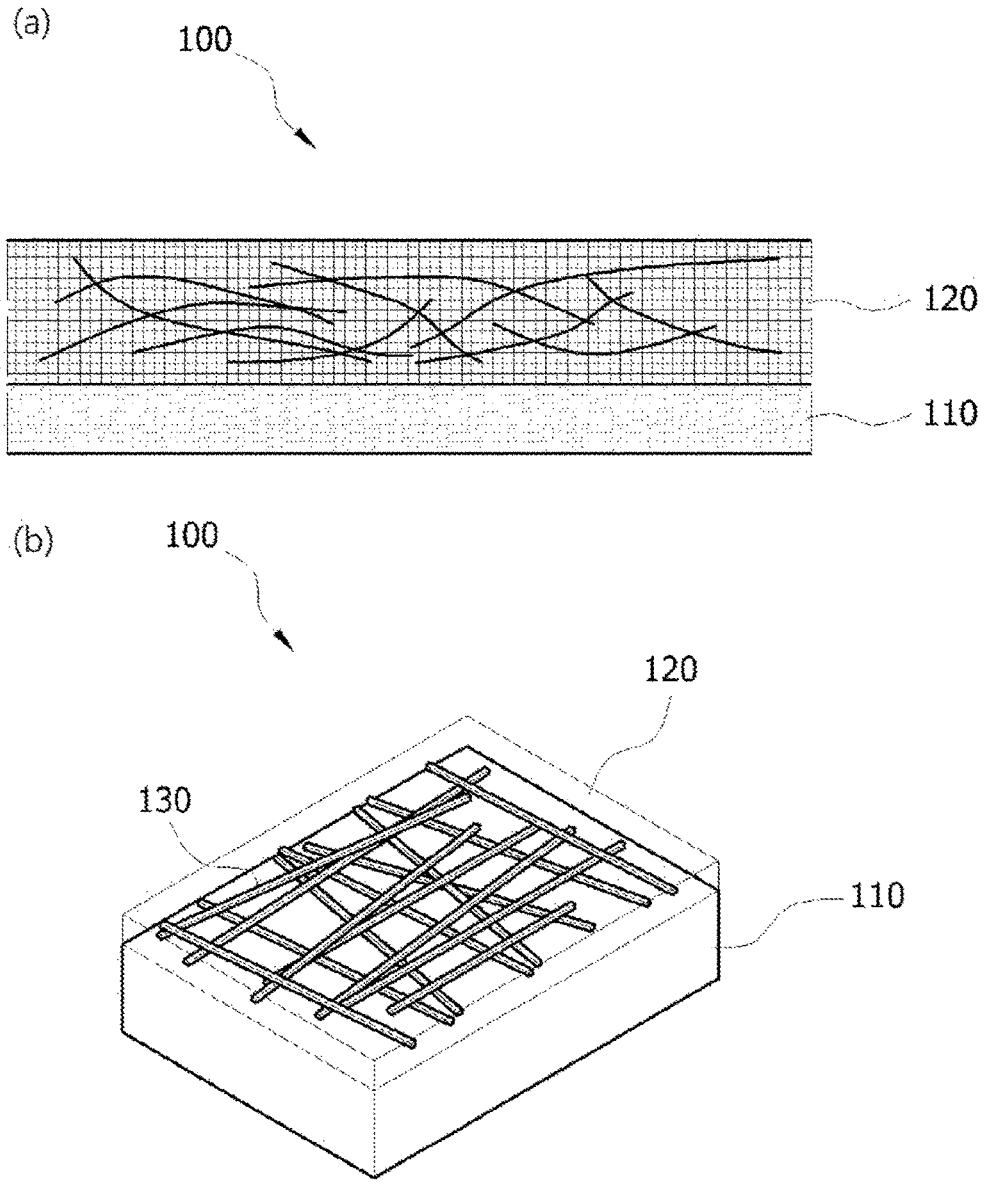
FIG. 3 schematically illustrates a conductive electrode film composed of one-dimensional polymer conductor-ultrathin silver nanowire hybrid layers according to one embodiment of the present invention.

FIG. 3 schematically illustrates a conductive electrode film composed of one-dimensional polymer conductor-ultrathin silver nanowire hybrid layers according to one embodiment of the present invention.

As shown in FIG. 3, a transparent, conductive electrode film 100 according to one embodiment of the present invention has a laminate structure of a conductive layer 120 on a substrate 110. The conductive layer 120 is a hybrid layer composed of the one-dimensional organic conductor and the silver nanowires 130, prepared using the above-described method while the substrate 110 is a transparent polymer film. The transparent, conductive electrode film is 500 nm or less thin, with a surface resistance of 5 ohm/□ to 150 ohm/□.

The one-dimensional polymer conductor may be selected from the group consisting of polythiophene, (poly)3,4-ethylene dioxythiophene, polyaniline, polypyrrole, polythiol, and derivatives thereof. The serial processes may be carried out stepwise or in a continuous manner.

The one-dimensional polymer conductor useful in the present invention has a structure of Chemical Formula 1.

In Chemical Formula 2, X is selected from the group consisting of sulfur (S) and NH; R1 and R2 are independently selected from the group consisting of hydrogen, an alkyl group of 3 to 15 carbon atoms, an ether group of 3 to 15 carbon atoms, and 3,4-ethylenedioxythiophene. The one-dimensional polymer conductor is formed into a film that is 10 to 500 nm thick.

In the present invention, the conjugated polymer having the heterocyclic structure of Chemical Formula 2 is hybridized with the silver nanowires, and the hybrid is directly applied as a conductive layer to a transparent polymer substrate film to give a transparent electrode film. Serving as an electrode material, the hybrid transparent electrode film according to the present invention may be used as at least one layer in organic solar cells or organic display devices.

That is to say, the transparent, conductive electrode film prepared according to the present invention may be a novel material that can function as an alternative to the conventional indium thin oxide (ITO) electrode, and can find applications in various fields including organic solar cells, organic semiconductors, and flexible display devices or film-type display devices. It is also useful for forming a functional composite film having at least one metal nanostructure.

The method for preparing a transparent, conductive electrode film according to the present invention is characterized by the direct application of a hybrid liquid for the formation of a transparent conductive thin film, which is distinct from conventional techniques in which multi-step coating processes are performed to form a nanowire film in a two-dimensional network structure.

For use in the present invention, the one-dimensional conductor is a conjugated polymer having a heterocyclic structure, as exemplified by polythiophene and derivatives thereof, and may be represented by Chemical Formula 2. The one-dimensional, conjugated polymers alone may be available as transparent conductors, but do not exhibit sufficient electrical properties to meet conditions for transparent electrodes. However, when combined with one-dimensional silver nanowires or when formed a composite conductor with one-dimensional silver nanowires, the one-dimensional conductor can exert superior electrical properties.

The preparation of a transparent electrode film by depositing a one-dimensional conductive polymer on or beneath a two-dimensional network thin film of silver nanowires or silver nano-loads is already known in the art, and is quite different from the present invention featuring the engagement of the silver nanowires with the one-dimensional organic polymer conductor on the same surface.

As described above, the hybrid film in which the silver nanowires and the one-dimensional polymer conductor are combined in the same layer can be used in a transparent, conductive electrode film, and the conductive elements combined with each other contribute to a synergistic improvement in the conductivity of the transparent, conductive electrode film, compared to the sum of conductivity from individual conductive elements.

In addition, the transparent, conductive electrode film based on the hybrid film composed of the ultrathin silver nanowires with a thickness of 10 to 30 nm and the one-dimensional polymer conductor is thin with a thickness of 500 nm or less, and has a light transmittance of 80% to 98% and a surface resistance of 5 to 150 ohm/□, in which both electrical and optical properties are improved by at least 10% each, compared to either a network structure of the silver nanowires alone or the one-dimensional organic conductor itself.

Particularly, the ultrathin silver nanowires with a thickness of 30 nm or less, prepared according to the present invention, exhibit a light transmittance of 80 to 98%, and can greatly reduce light scattering, thus reducing haze value by at least 20%. As used herein, the term "haze" refers to an index of light scattering, and is expressed as percentage of the quantity of scattered light during the penetration of light.

A better understanding of the present invention may be obtained through the following examples which are set forth to illustrate, but are not to be construed as limiting the present invention.

EXAMPLE 1-1

In Example 1-1, 0.56 g of polyvinylpyrrolidone (PVP, Mw: 1,300,000), and 0.48 g of silver nitrate (AgNO3) were dissolved in 60 mL of ethylene glycol, and introduced into a hydrothermal reactor to which a solution containing 0.025 g of NaCl and 0.045 g of KBr in 50 mL of ethylene glycol was then added.

Subsequently, the mixture was heated to 150° C. while stirring. Once nanoparticle-type silver seeds with a size of 100 nm were formed, a pressure of 50 psi was applied to the solution for 70 min in a nitrogen (N2) atmosphere to induce the seeds to selectively grow in the (110) direction.

Thereafter, the solution was cooled to 4 to 25° C. A phase separation was made with acetone, and the supernatant thus formed was removed because ethylene glycol, silver nanoparticles and polyvinylpyrrolidone were dispersed therein. After this process was repeated three times, the ultrathin silver nanowires thus purified were dispersed in 30 mL of distilled water.

Figure 4:
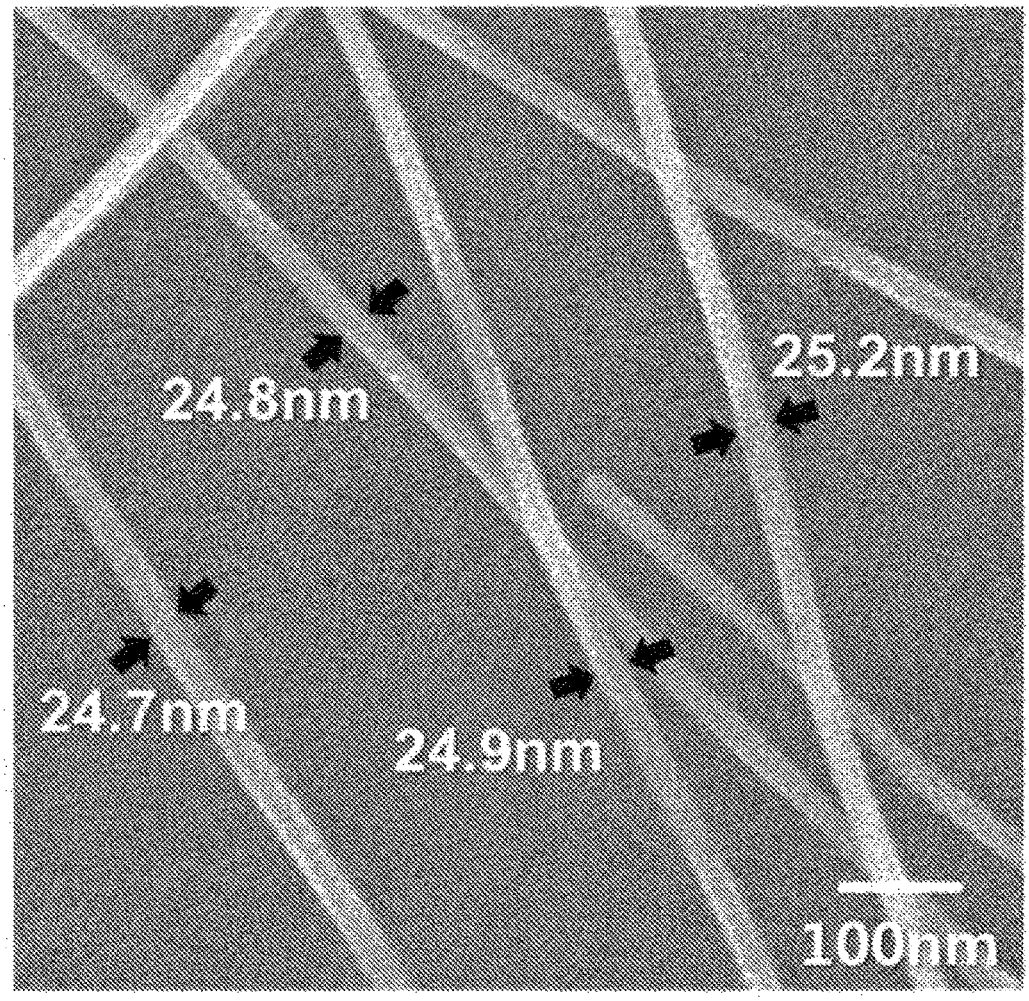
FIG. 4 is an SEM (scanning electron microscope) image of the ultrathin silver nanowires prepared according to Example 1-1 of the present invention.

FIG. 4 is an SEM (scanning electron microscope) image of the ultrathin silver nanowires prepared according to Example 1-1 of the present invention.

As can be seen in FIG. 4, the ultrathin silver nanowires prepared in Example 1-1 were observed as wire-shaped crystals with a diameter of approximately 24 to 26 nm, and had a length of 15 to 20 μm.

EXAMPLE 1-2

Silver nanowires were prepared in the same manner as in Example 1-1, with the exception that a solution of polyvinylpyrrolidone, silver nitrate, NaCl and KBr in ethylene glycol was pressurized under a pressure of 100 psi for 60 min in a nitrogen (N2) atmosphere.

Figure 5:
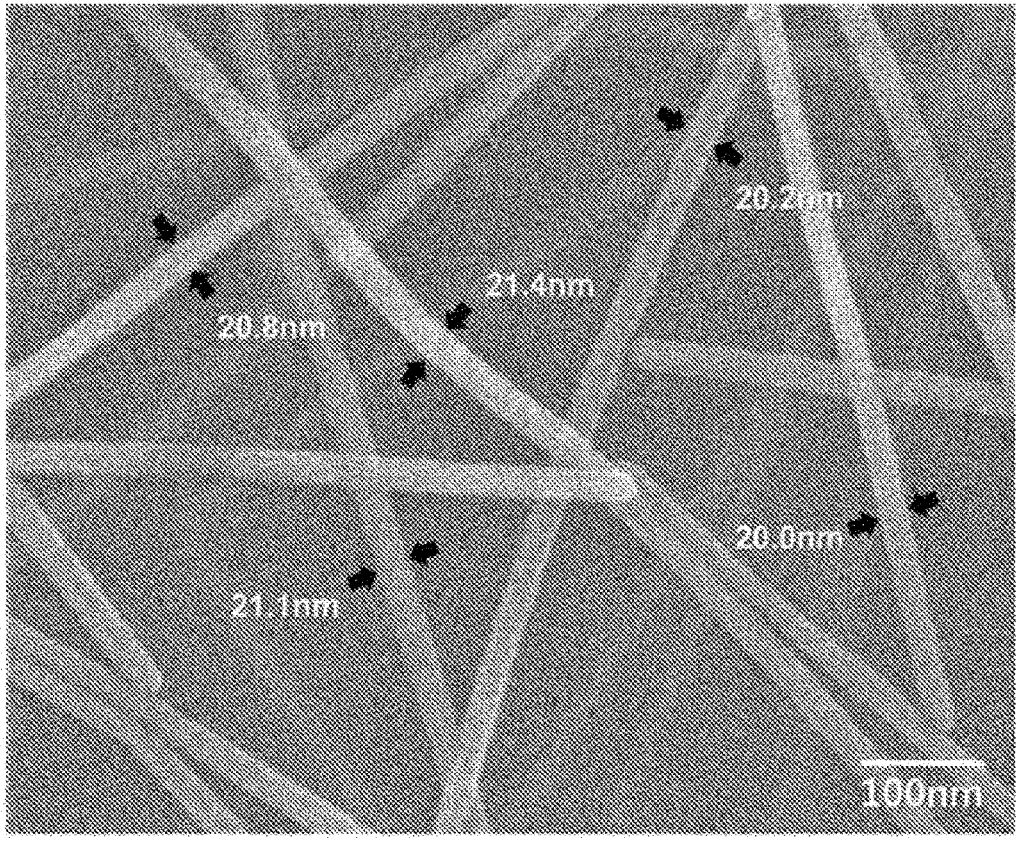
FIG. 5 is an SEM image of the ultrathin silver nanowires prepared in Example 1-2.

FIG. 5 is an SEM image of the ultrathin silver nanowires prepared in Example 1-2.

Figure 6:
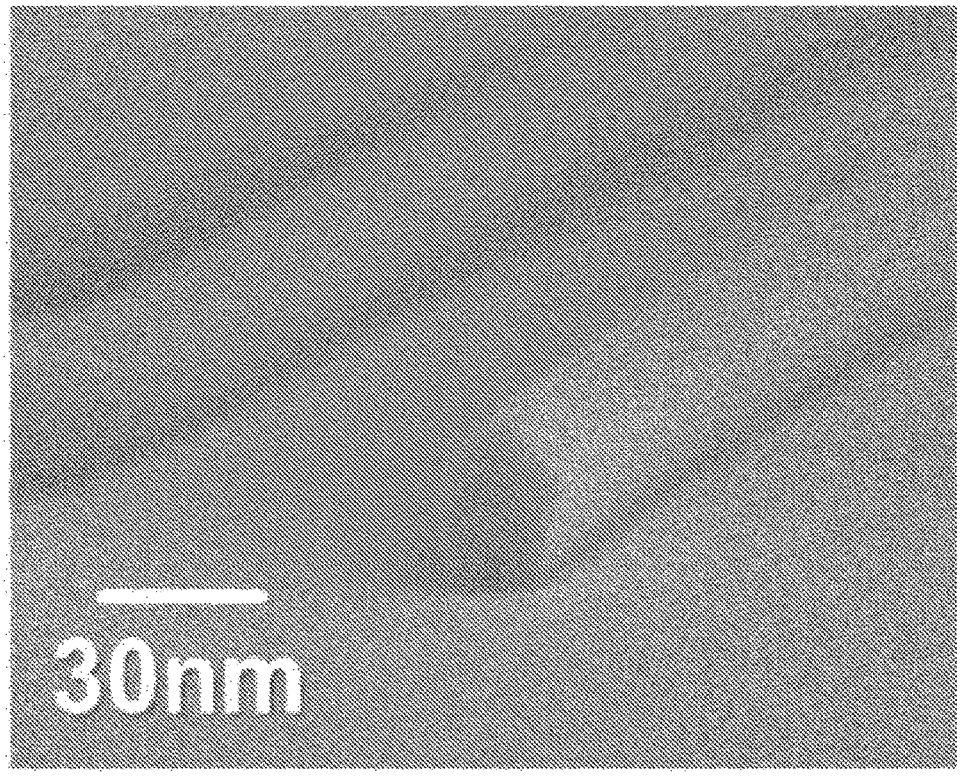
FIG. 6 is a magnified SEM image of the ultrathin silver nanowires prepared in Example 1-2.

FIG. 6 is a magnified SEM image of the ultrathin silver nanowires prepared in Example 1-2.

As shown in FIGS. 5 and 6, the ultrathin silver nanowires prepared in Example 1-2 had a diameter of approximately 20 nm to 22 nm, with an aspect ratio of approximately 400 to 500, indicating that they were significantly restrained from growing in a thickness-wise direction and were more homogeneous in diameter, compared to conventional silver nanowires having an average diameter of 40 nm to 80 nm.

EXAMPLE 1-3

Silver nanowires were prepared in the same manner as in Example 1-1, with the exception that a solution of polyvinylpyrrolidone, silver nitrate, NaCl and KBr in ethylene glycol was pressurized under a pressure of 400 psi for 50 min in a nitrogen (N2) atmosphere.

The ultrathin silver nanowires prepared in Example 1-3 had a diameter of approximately 12 nm to 15 nm, with an aspect ratio of approximately 300 to 350, indicating that they were significantly restrained from growing in thickness and were homogeneous in diameter. In addition, the silver nanowires were observed to measure approximately 15 μm in length on average.

EXAMPLE 1-4

For use as a transparent electrode film, the silver nanowires prepared in above Examples may be formulated into an ink composition. Typically, the ink composition comprises a surfactant, a viscosity controlling agent, and a polymer binder as a matrix for immobilization on a dispersion or substrate of silver nanowires. The ink composition is used as an index for the charge density of the final conductive film formed on the substrate.

First, a water-dispersed, ink composition of ultrathin silver nanowires was prepared. The ultrathin silver nanowires were approximately 15 μm long, with a diameter of 24 to 26 nm. The ink composition contained 0.5% by weight of ultrathin silver nanowires, 0.01% by weight of a dispersant (Zonyl FSH), and 0.2% by weight of a thickener (hydroxypropyl methyl cellulose), and was subjected to surface treatment with plasma in a liquid phase to activate the surface of the ultrathin silver nanowires.

After the surface activation with plasma, the ultrathin silver nanowires were combined at a ratio of 1:1 with a one-dimensional polymer conductor composed of (poly)3,4-ethylenedioxythiophene to give a hybrid. Thereafter, the ultrathin silver nanowire/one-dimensional organic conductor hybrid composite, transparent conductive ink was directly applied to a substrate using a spin coating method or a wet coating method, such as microgravure or a slot die method, followed by drying at 180° C. for 2 min. The transparent, conductive electrode film thus formed with a thickness of approximately 80 to 100 nm was observed to have a light transmittance of 94% (based on the substrate) and a haze of 1.5%, and exhibited a surface resistance of approximately 30 ohm/□.

EXAMPLE 1-5

A transparent conductive electrode film was prepared in the same manner as in Example 1-4, with the exception that a one-dimensional polymer conductor composed of (poly) 3,4-ethylene dioxythiophene was combined at a ratio of 0.5:1 with the ultrathin silver nanowires to form a hybrid.

The transparent, conductive electrode film formed at a thickness of approximately 80 to 100 nm was measured to have a light transmittance of 97% (based on the substrate) and a haze of 1.2%, with a surface resistance of approximately 60 ohm/□.

The transparent, conductive electrode film based on the hybrid composed of the one-dimensional polymer conductor and the ultrathin silver nanowires can be prepared in a continuous process, and can be formed to vary in electrical conductivity from 5 ohm/□ to 150 ohm/□ depending on the structure or content of the one-dimensional polymer conductor and the content or size of the ultrathin silver nanowires, so that it can be used as a low resistance electrode material.

In addition to improving the conductivity of the transparent, conductive electrode film, the one-dimensional conjugated conductor combined with ultrathin silver nanowires contributed to the smoothness and transparency of the film, increasing light transmittance by at least 5%.

COMPARATIVE EXAMPLE 1

Silver nanowires were prepared in the same manner as in Example 1-1, with the exception that a solution of polyvinylpyrrolidone, silver nitrate, NaCl and KBr in ethylene glycol was pressurized under a pressure of 15 psi for 80 min in a nitrogen (N2) atmosphere.

The silver nanowires thus obtained were observed to have a diameter of approximately 40 to 60 nm.

EXPERIMENTAL EXAMPLE 1-1

The silver nanowires prepared in Examples 1-1, 1-2, and 1-3, and Comparative Example 1 were measured for XRD pattern.

Figure 7:
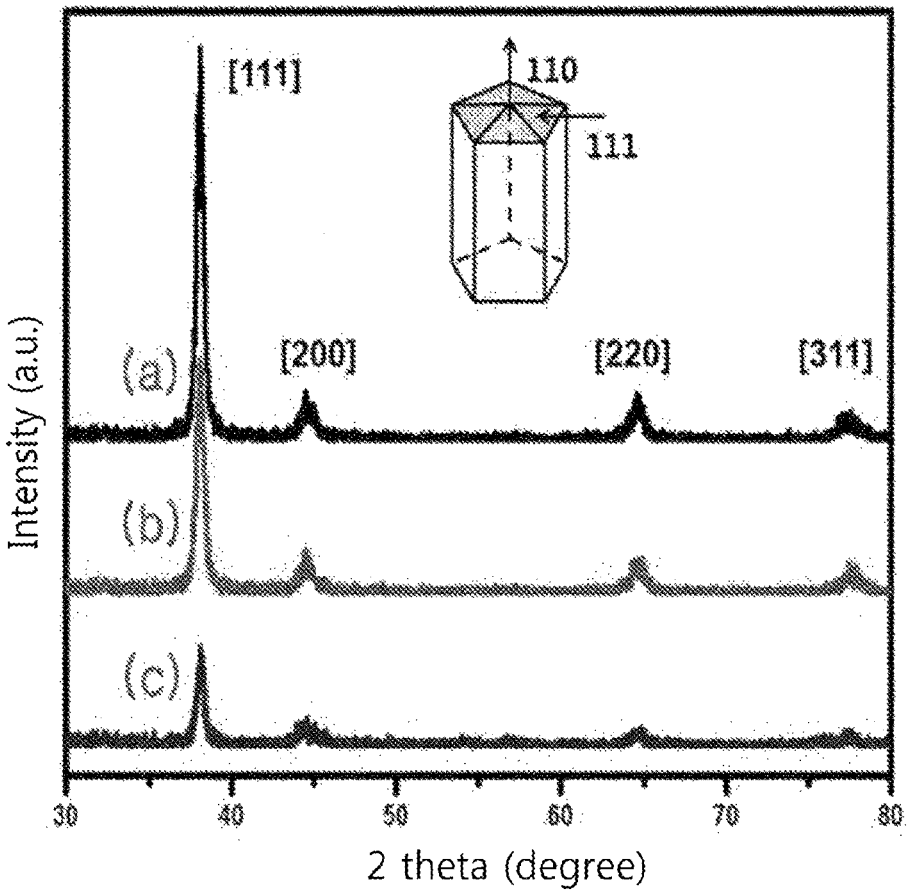
FIG. 7 shows XRD (X-ray diffraction) patterns of the silver nanowires according Experimental Example 1-1.

FIG. 7 shows XRD (X-ray diffraction) patterns of the silver nanowires prepared in Comparative Example 1(a), Example 1-1(b), and Example 1-2(c).

As shown in FIG. 7, peaks corresponding to (111) face, (200) face, (220) face and (311) face are observed in the XRD patterns, indicating that the silver nanowires are crystals having a face centered cubic structure.

From the observation that the peak corresponding to the (111) face is higher in intensity, compared to the peak corresponding to the (200) face, it is understood that the silver nanowires prepared in Examples 1-1 and 1-2 and Comparative Example 1 resulted from the growth of the silver seeds in the (111) face direction.

EXPERIMENTAL EXAMPLE 1-2

Surface plasmon resonance (SPR) spectra of silver nanowires prepared in Examples 1-1 and 1-2, and Comparative Example 1 were compared. SPR is the basis of many standard tools for measuring adsorption of material onto planar metal (typically gold and silver) surfaces or onto the surface of metal nanoparticles, producing a characteristic spectrum of scattered light that is dependent on the size and morphology of the nanostructure.

Figure 8:
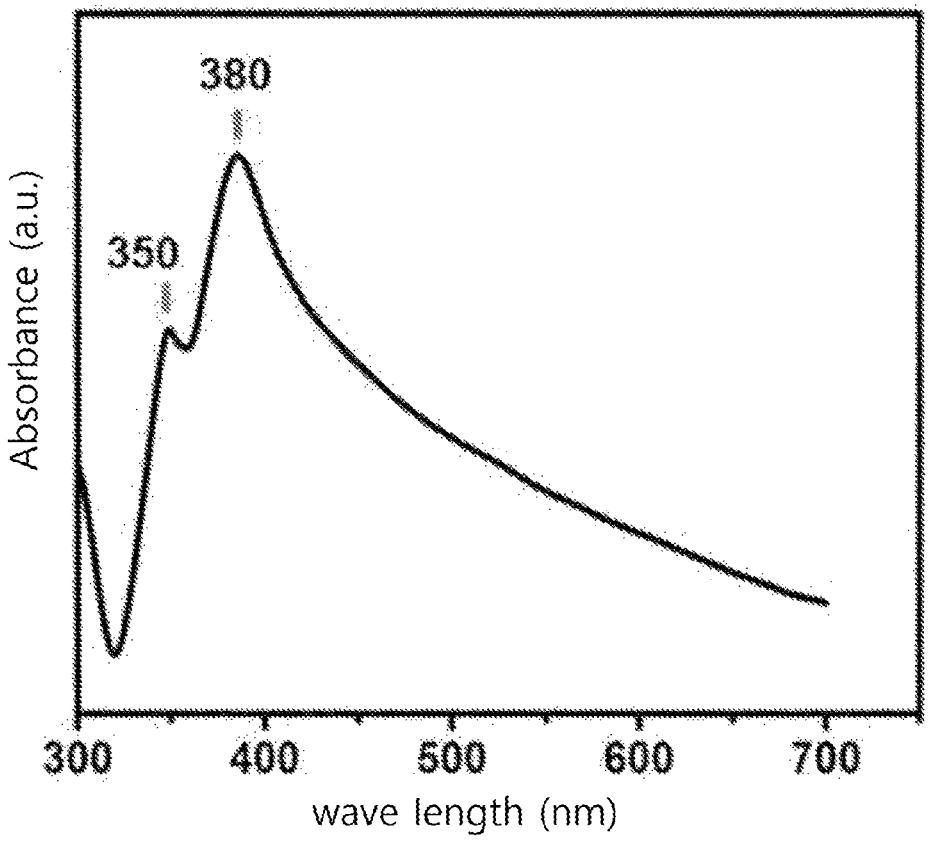
FIG. 8 is an SPR spectrum of the silver nanowires with a diameter of 40 to 60 nm, prepared in Comparative Example 1.
Figure 9:
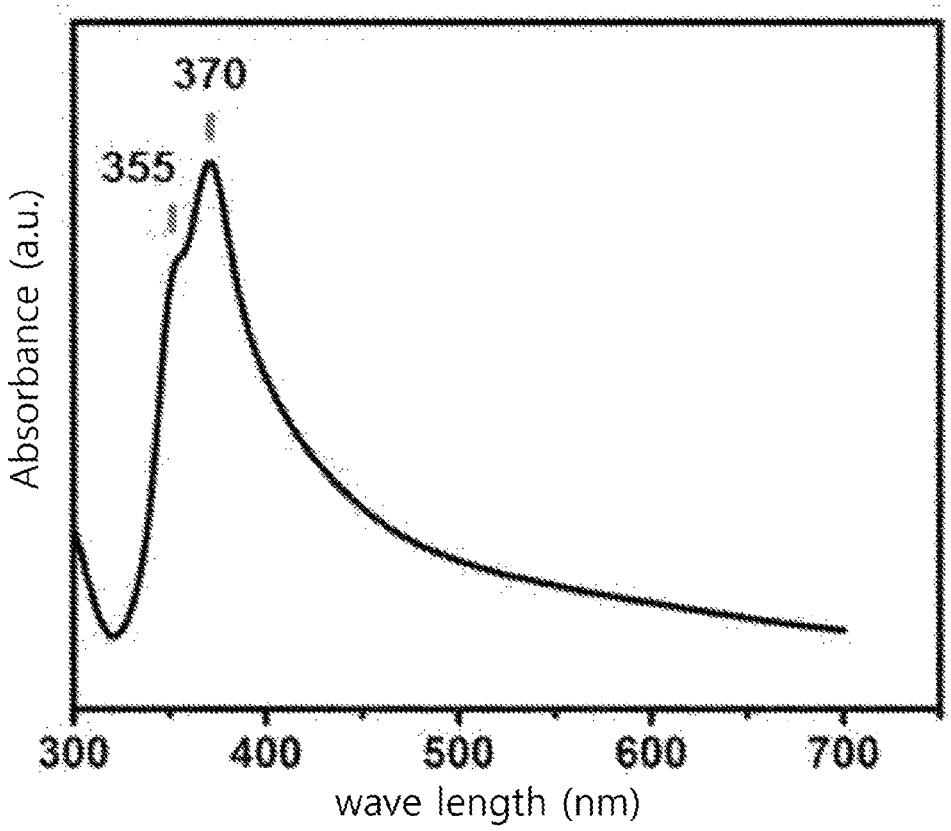
FIG. 9 is an SPR spectrum of the silver nanowires with a diameter of 24 to 26 nm, prepared in Example 1-1.

FIG. 8 is an SPR spectrum of the silver nanowires with a diameter of 40 to 60 nm, prepared in Comparative Example 1. FIG. 9 is an SPR spectrum of the silver nanowires with a diameter of 24 to 26 nm, prepared in Example 1-1, and FIG. 10 is an SPR spectrum of the silver nanowires with a diameter of 20 to 22 nm, prepared in Example 1-2.

Figure 10:
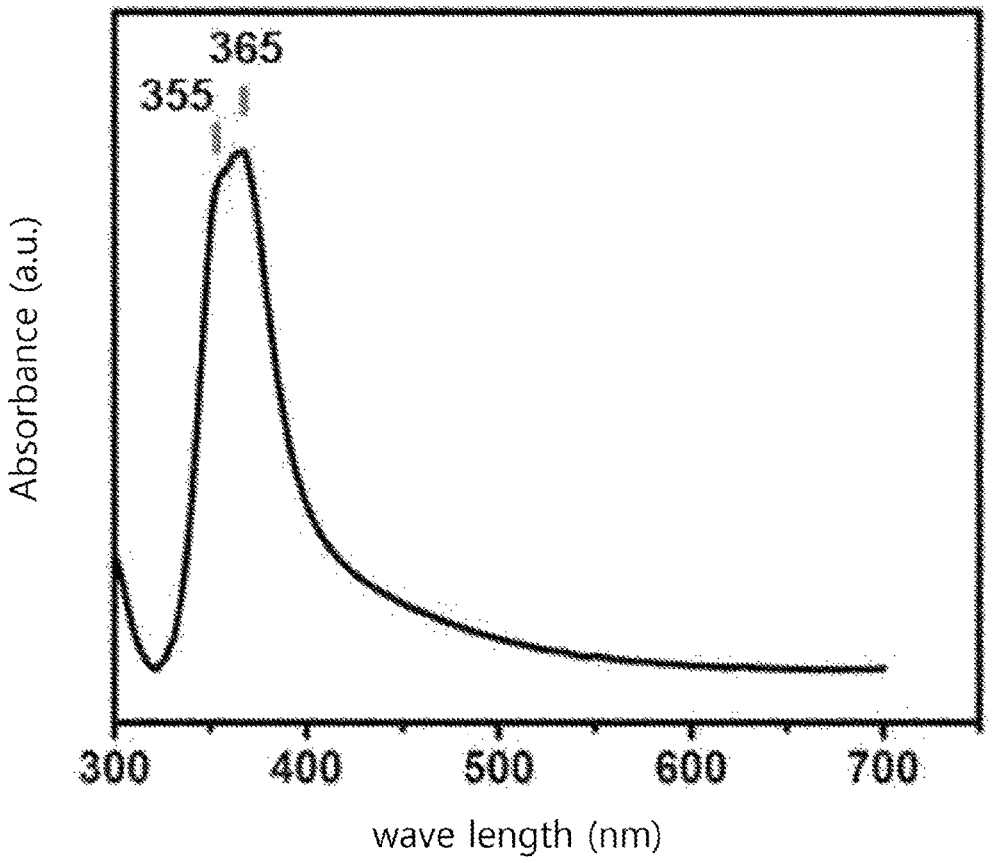
FIG. 10 is an SPR spectrum of the silver nanowires with a diameter of 20 to 22 nm, prepared in Example 1-2.

As can be seen in FIGS. 8 to 10, two characteristic peaks are observed in each of the spectra, and the right peaks that correspond to the SPR in the short-axis direction of the silver nanowires are reduced in the wavelength from 380 nm to 370 nm and to 365 nm, exhibiting a blue shift. Thus, the ultrathin silver nanowires prepared in the present invention have characteristic SPR between 365 nm and 370 nm, which is attributed to a diameter reduction under a pressure during synthesis.

In greater detail, the ultrathin silver nanowires are thin with a diameter of 30 nm and are characterized by characteristic plasmon resonance between 365 nm and 370 nm.

EXPERIMENTAL EXAMPLE 1-3

Transparent, conductive electrode films based on the ultrathin silver nanowires prepared in above Examples were examined for light transmittance and surface resistance.

Depending on the content of the ultrathin silver nanowires, the transparent, conductive electrode films of the present invention were measured to range in surface resistance from 5 ohm/□ to 80 ohm/□, with a light transmittance of approximately 82% or higher. The surface resistance was improved by at least 10%, compared to that of the two-dimensional network thin film prepared with the ultrathin silver nanowires alone, thus resulting from the hybridization of the ultrathin silver nanowires with the one-dimensional polymer conductor.

From the measurements, it is understood that the ultrathin silver nanowires prepared using the method of the present invention can be used for constructing transparent, conductive electrode films superior in optical properties such as a light transmittance.

EXAMPLE 2-1

A 0.35 mol polyvinylpyrrolidone (PVP, Mw: 1,300,000) solution, a 0.01 mol 1-butyl-3-methyl-imidazolium tetrachloroferrate solution (magnetic ionic liquid), a 0.03 mol 1-butyl-3-methyl-imidazolium bromide solution and a 0.2 mol silver nitrate (AgNO3) solution were prepared in ethylene glycol. Together with 160 mL of ethylene glycol, 50 mL of the polyvinylpyrrolidone solution, 20 mL of the 1-butyl-3-methyl-imidazolium tetrachloroferrate solution, and 20 mL of the 1-butyl-3-methyl-imidazolium bromide solution were introduced into a 120° C. high-pressure polyol reactor, and reacted for 60 min while stirring at 500 rpm. Once a silver seed occurred after 20 min of the reaction, the reaction mixture was heated to 170° C. while applying a pressure of up to 500 psi to the polyol reactor in a nitrogen (N2) gas atmosphere so as to induce the silver seed to selectively grow in the lengthwise direction.

After completion of the reaction, the mixture solution was cooled to 25° C. Then, acetone was added to the cooled mixture solution, and the resulting supernatant in which ethylene glycol, silver nanoparticles and polyvinylpyrrolidone were dispersed was withdrawn. This separation process was repeated five or more times to obtain pure silver nanowires that were then again dispersed in 15 mL of distilled water.

Figure 11:
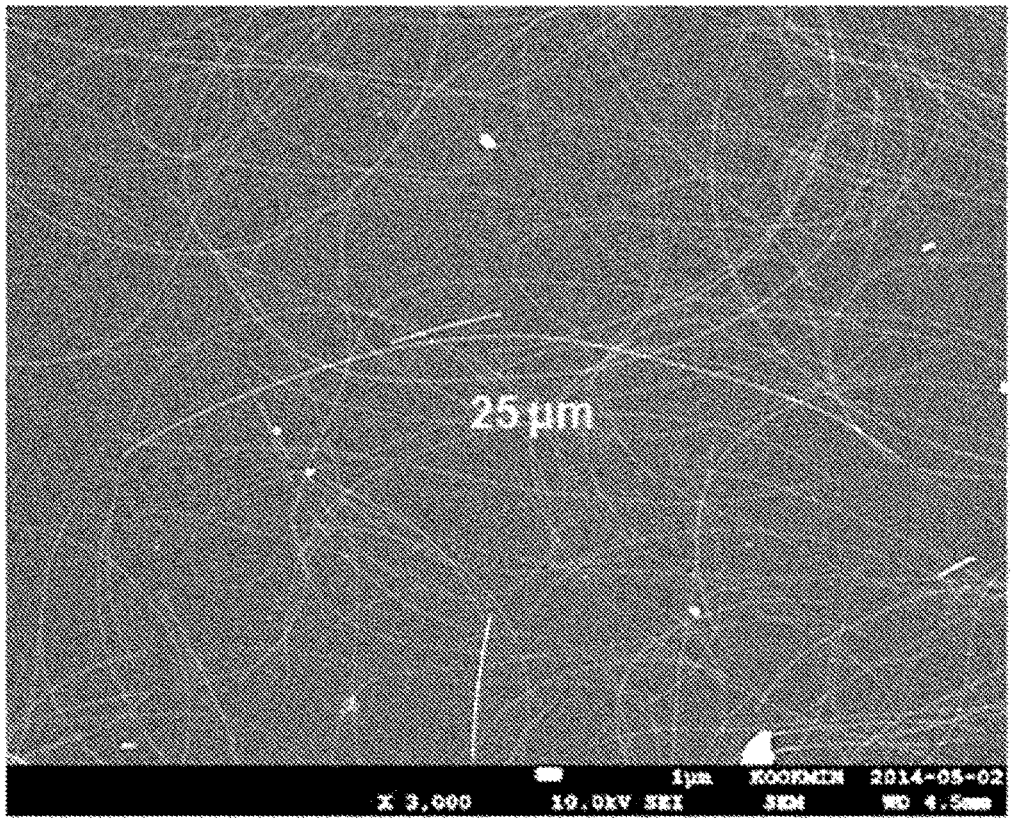
FIG. 11 is an SEM image of the ultrathin silver nanowires prepared according to Example 2-1 of the present invention.

FIG. 11 is an SEM image of the ultrathin silver nanowires prepared according to Example 2-1 of the present invention.

Figure 12:
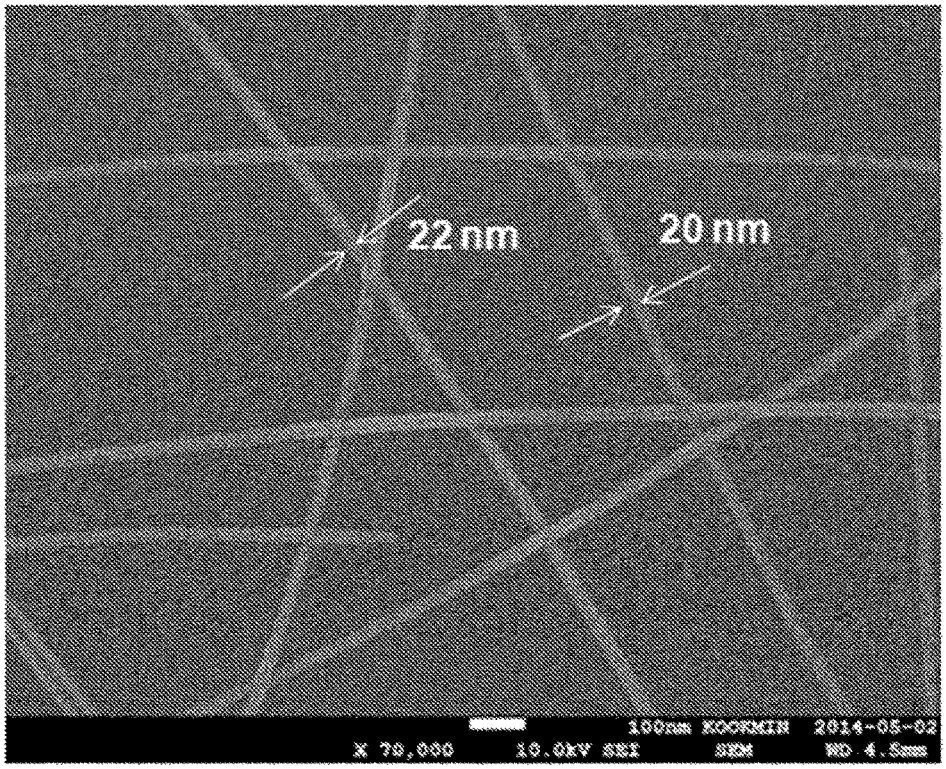
FIG. 12 is a magnified SEM image of the ultrathin silver nanowires prepared according to Example 2-1 of the present invention.

FIG. 12 is a magnified SEM image of the ultrathin silver nanowires prepared according to Example 2-1 of the present invention.

As can be seen in FIGS. 11 and 12, the ultrathin silver nanowires prepared in Example 1-1 were observed as wire-shaped crystals with a diameter of approximately 20 to 23 nm, and had a length of 25 μm on average.

Figure 13:
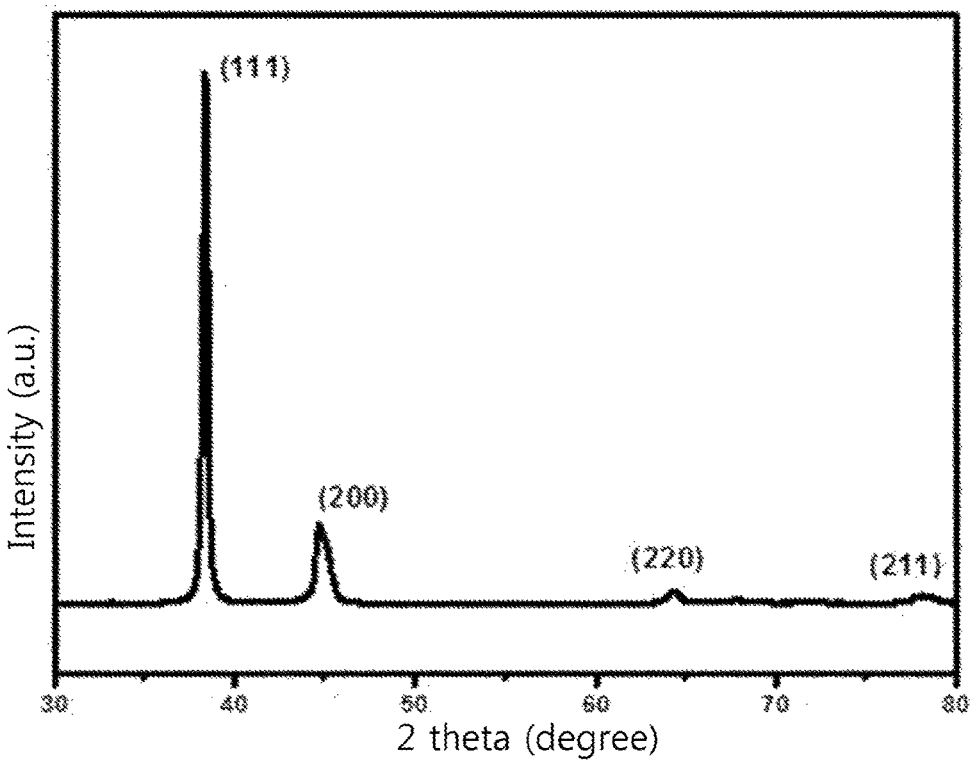
FIG. 13 is an XRD pattern of the silver nanowires prepared in Example 2-1.

FIG. 13 is an XRD pattern of the silver nanowires prepared in Example 2-1.

As shown in FIG. 13, detection of respective peaks corresponding to the (111), (200), (220), and (311) faces indicates that the silver nanowires prepared in Example 2-1 are crystals having a face centered cubic structure. From the observation that the peak corresponding to the (111) face is higher in intensity, compared to the peak corresponding to the (200) face, it is also understood that the silver nanowires prepared in Example 2-1 resulted from the growth of the silver seeds in the (111) face direction.

In addition, the silver nanowires prepared in Example 2-1 was very thin and long, with a diameter of 20 to 23 nm and a length of 25 μm, exhibiting a characteristic plasmon resonance effect. SPR produces a characteristic spectrum of scattered light that is dependent on the size and morphology of the nanostructure.

Figure 14:
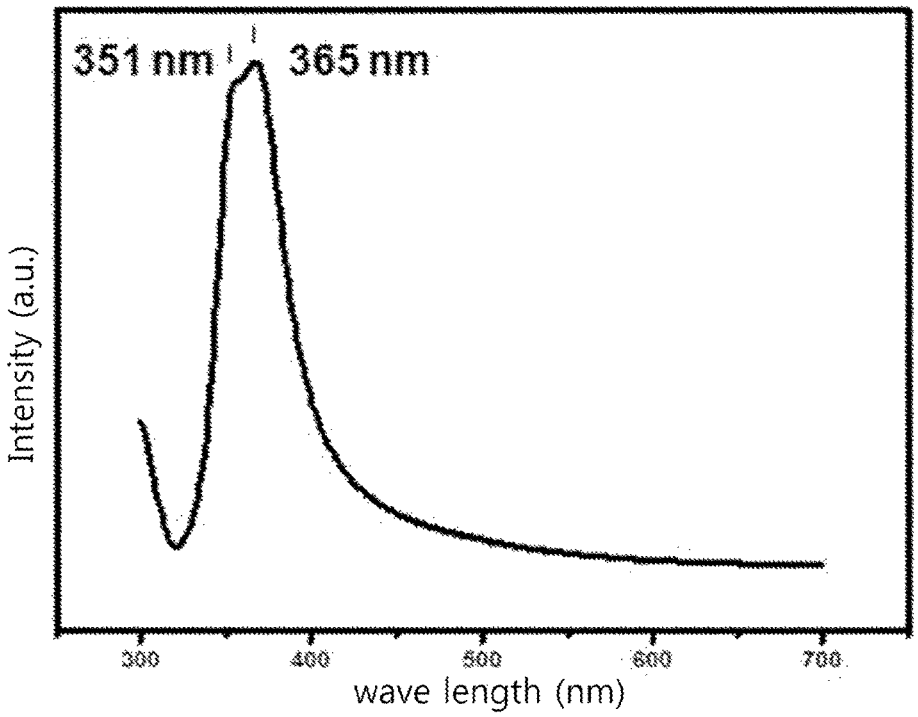
FIG. 14 is an SPR spectrum of the ultrathin silver nanowires with a diameter of 20 to 23 nm, prepared according to Example 2-1 of the present invention.

FIG. 14 is an SPR spectrum of the ultrathin silver nanowires with a diameter of 20 to 23 nm, prepared according to Example 2-1 of the present invention.

As can be seen in FIG. 14, the ultrathin silver nanowires of Example 2-1 were observed to have characteristic absorption bands at 351 nm and 365 nm.

EXAMPLE 2-2

Silver nanowires were prepared in the same manner as in Example 2-1, with the exception that a pressure of 1,000 psi was applied for 60 min in a nitrogen (N2) atmosphere.

The ultrathin silver nanowires prepared in Example 2-2 had a diameter of approximately 15 nm to 20 nm and an aspect ratio of approximately 1,000, indicating that they were significantly restrained from growing in thickness and were more homogeneous in diameter. Other properties were not different from those of the silver nanowires prepared in Example 2-1.

EXAMPLE 2-3

Silver nanowires were prepared in the same manner as in Example 2-1, with the exception that a pressure of 100 psi was applied for 60 min in a nitrogen (N2) atmosphere.

The ultrathin silver nanowires prepared in Example 2-3 measured approximately 22 to 25 nm in thickness and approximately 20 μm in length, with an aspect ratio of approximately 800. On the SPR spectrum of the silver nanowires, characteristic absorption bands were detected at 351 nm and 368 nm. Other properties were the same as in those of the ultrasilver nanowires prepared in Example 2-1.

EXAMPLE 2-4

Silver nanowires were prepared in the same manner as in Example 2-1, with the exception that 50 mL of a 0.35 mol polyvinylpyrrolidone (PVP, Mw: 55,000) solution, 20 mL of a 0.005mol 1-ethyl-3-methyl-imidazolium tetrachloroferrate solution, 20 mL of a 0.006mol 1-ethyl-3-methyl-imidazolium bromide solution, 60 mL of a 0.15 mol silver nitrate (AgNO3), all solutions being prepared in ethylene glycol, were used, together with 160 mL of ethylene glycol.

The silver nanowires prepared in Example 2-4 were observed as wire-shaped crystals with a diameter of approximately 18 to 20 nm, and characteristic absorption bands were detected at 351 nm and 365 nm on the SPR spectrum of the silver nanowires. Other properties were the same as in Example 2-1, with the exception that the silver nanowires were 15 μm long on average.

EXAMPLE 2-5

Silver nanowires were prepared in the same manner as in Example 2-1, with the exception that 50 mL of a 0.3 mol polyvinylpyrrolidone (PVP, Mw: 55,000) solution, 20 mL of a 0.001 mol 1-butyl-3-ethyl-imidazolium tetrachloroferrate solution, and 60 mL of a 0.1 mol silver nitrate (AgNO3), all solutions being prepared in ethylene glycol, were used, together with 160 mL of ethylene glycol.

The silver nanowires prepared in Example 2-5 were observed as wire-shaped crystals with a diameter of approximately 35 to 45 nm, and ranged in length from 20 to 30 μm on average. The silver nanowires were relatively thick. Characteristic absorption bands were detected at 350 nm and 376 nm on the SPR spectrum of the silver nanowires. Other properties were the same as in Example 2-1.

COMPARATIVE EXAMPLE 2-1

Silver nanowires were prepared in the same manner as in Example 2-1, with the exception that 50 mL of a 0.3 mol polyvinylpyrrolidone (PVP, Mw: 1,300,000) solution, 20 mL of a 0.001 mol FeCl3, and 60 mL of a 0.1 mol silver nitrate (AgNO3), all solutions being prepared in ethylene glycol, were used, together with 180 mL of ethylene glycol.

No magnetic liquids were used, and instead, the same mole number of FeCl3 was employed. The silver nanowires prepared in Comparative Example 2-1 were observed as wire-shaped crystals with a diameter of approximately 40 to 50 nm, and ranged in length from 25 to 30 μm on average. Characteristic absorption bands were detected at 350 nm and 381 nm on the SPR spectrum of the silver nanowires. Other properties were the same as in Example 2-1.

COMPARATIVE EXAMPLE 2-2

Silver nanowires were prepared in the same manner as in Comparative Example 2-1, with the exception that 50 mL of a 0.3 mol polyvinylpyrrolidone (PVP, Mw: 1,300,000) solution, 20 mL of a 0.001 FeCl3 solution, 60 mL of a 0.15 mol silver nitrate (AgNO3), all solutions being prepared in ethylene glycol, were used, together with 160 mL of ethylene glycol, and that a pressure of 1,000 psi was applied to the solutions for 60 min in a nitrogen (N2) atmosphere.

The silver nanowires prepared in Comparative Example 2-2 measured approximately 30 to 35 nm in thickness, with an aspect of approximately 800, indicating that they were significantly restrained from growing in thickness, compared to those of Comparative Example 2-1. The silver nanowires were homogeneous in diameter. Other properties were not different from those in Example 2-1.

EXAMPLE 2-6

For use as a transparent electrode film, the silver nanowires prepared in above Examples may be formulated into an ink composition. Typically, the ink composition comprises a surfactant, a viscosity controlling agent, and a polymer binder as a matrix for the two-dimensional immobilization of silver nanowires on a dispersion or substrate. The ink composition is used as an index for the charge density of the final conductive film formed on the substrate.

First, a water-dispersed, ink composition of ultrathin silver nanowires was prepared. The ultrathin silver nanowires prepared in Example 2-1 were approximately 25 μm long, with a diameter of 20 to 23 nm. The ink composition contained 0.5% by weight of ultrathin silver nanowires, 0.01% by weight of a dispersant (Zonyl FSH), and 0.2% by weight of a thickener (hydroxypropyl methyl cellulose). A water dispersion of the ultrathin silver nanowires was combined at a ratio of 1:1 with a one-dimensional polymer conductor composed of (poly)3,4-ethylenedioxythiophene to give a hybrid. Thereafter, the ultrathin silver nanowire/one-dimensional organic conductor hybrid composite, transparent conductive ink was directly applied to a substrate using a spin coating method or a wet coating method, such as microgravure or a slot die method, followed by drying at 180° C. for 2 min.

The transparent, conductive electrode film thus formed with a thickness of approximately 80 to 100 nm was observed to have a light transmittance of 94% (based on the substrate) and a haze of 1.5%, and exhibited a surface resistance of approximately 30 ohm/□.

EXAMPLE 2-7

A transparent conductive electrode film was prepared in the same manner as in Example 2-6, with the exception that a one-dimensional polymer conductor composed of (poly) 3,4-ethylene dioxythiophene was combined at a ratio of 0.5: 1 with the ultrathin silver nanowires to form a hybrid.

The transparent, conductive electrode film formed at a thickness of approximately 80 to 100 nm was measured to have a light transmittance of 97% (based on the substrate) and a haze of 1.2%, with a surface resistance of approximately 60 ohm/□.

The transparent, conductive electrode film based on the hybrid composed of the one-dimensional polymer conductor and the 20 nm-thick, ultrathin silver nanowires can be prepared in a continuous process, and can be formed to vary in electrical conductivity from 5 ohm/□ to 150 ohm/□ depending on the structure or content of the one-dimensional polymer conductor and the content or size of the ultrathin silver nanowires, so that it can be used as an low resistance electrode material.

In addition to improving the conductivity of the transparent, conductive electrode film, the one-dimensional conjugated conductor combined with ultrathin silver nanowires contributed to the smoothness and transparency of the film, increasing a light transmittance by at least 5%.

As can be seen in FIG. 14, two characteristic peaks are observed in the spectrum, and the right peak that corresponds to the SPR in the short-axis direction of the silver nanowires is detected at 365 nm, exhibiting an optical property specific for the ultrathin silver nanowires.

Positions of the characteristic peaks on the absorption wavelength axis sensitively correspond to the diameter of the silver nanowires, and shift towards shorter wavelengths (blue shift) at higher pressures.

Thus, the ultrathin silver nanowires prepared in the present invention have a characteristic SPR between 365 nm and 370 nm, which is attributed to a diameter reduction under a pressure during synthesis.

In greater detail, the ultrathin silver nanowires are thin with a diameter of 20 nm and are characterized by characteristic plasmon resonance between 365 nm and 370 nm.

The transparent, conductive electrode films comprising the ultrathin silver nanowires, prepared in Examples 2-6 and 2-7, were measured to have a light transmittance of approximately 85% or more, and to vary in surface resistance from 5 ohm/□ to 80 ohm/□ depending on the content of the ultrathin silver nanowires. Both electrical and optical properties are improved by at least 10% each, compared to those of a network structure of the silver nanowires having a thickness of 30 nm or more. This improvement is attributed to the fact that the ultrathin silver nanowires reduce light scattering.

According to the methods for preparing ultrathin silver nanowires of the present invention, the silver nanowires are restrained from growing in thickness under a certain pressure, so that they are 30 nm or less in thickness with a narrow diameter distribution, which leads to an improvement in aspect ratio. A film to which the silver nanowires are applied exhibits a low haze value.

In addition, given the ultrathin silver nanowires, a transparent, conductive electrode film was found to have greatly improved optical properties, and exhibited a light transmittance of 80% to 98% and a surface resistance of 5 to 150 ohm/□.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for preparing ultrathin silver nanowires, comprising performing the following steps in sequential order:

(a) dissolving a silver salt and a capping agent in a reducing solvent to give a mixture solution;

(b) adding a halide compound to the mixture solution to yield a silver seed;

(c) heating the mixture solution and then allowing the heated mixture solution to grow ultrathin silver nanowires from the silver seed under a pressure in an inert gas atmosphere, wherein the pressure is between 50 and 500 psi; and (d) cooling the mixture solution in which the ultrathin silver nanowires have grown, followed by purification and separation to obtain the ultrathin silver nanowires.

2. A method for preparing ultrathin silver nanowires, comprising:

1) dissolving a magnetic ionic liquid containing tetrachloroferrate, and a capping agent in a reducing solvent to give a mixture solution;

2) adding a silver salt to the mixture solution to yield a silver seed;

3) heating the mixture solution and then allowing the heated mixture solution to grow ultrathin silver nanowires from the silver seed under a pressure in an inert gas atmosphere, wherein the pressure is between 100 and 1500 psi; and 4) cooling the mixture solution in which the ultrathin silver nanowires have grown, followed by purification and separation to obtain the ultrathin silver nanowires.

3. The method of claim 1, wherein the silver salt is silver nitrate, silver acetate, or silver perchlorate.

4. The method of claim 1, wherein the capping agent is selected from the group consisting of polyvinylpyrrolidone (PVP), polyvinylalcohol (PVA), cetyltrimethylammoniumbromide (CTAB), cetyltrimethylammoniumchloride (CTAC), polyacrylamide (PAA), and a combination thereof.

5. The method of claim 1, wherein the capping agent is used in an amount of 1.50 to 3.50 mol per mole of the silver salt.

6. The method of claim 1, wherein the reducing solvent is polyol.

7. The method of claim 6, wherein the reducing solvent is selected from the group consisting of ethylene glycol, 1,2-propylene glycol, 1,3-propylene glycol, glycerin, glucose, and a combination thereof.

8. The method of claim 2, wherein the magnetic ionic liquid containing tetrachloroferrate further comprises a halide compound different from tetrachloroferrate.

9. The method of claim 1, wherein the halide compound is a metal halide selected from the group consisting of sodium chloride (NaCl), potassium bromide (KBr), potassium iodide (KI), iron trichloride ($FeCl_3$), platinum trichloride ($PtCl_3$), gold trichloride ($AuCl_3$), and a combination thereof.

10. The method of claim 1, wherein the halide compound is an organic halide selected from the group consisting of tetrabutylammonium chloride, tetrahexyl ammonium chloride, tetrapropylammonium chloride, tetrabutylammonium bromide, tetrahexyl ammonium bromide, tetrapropylammonium bromide, tetrabutylphosphoniumbromide, and a combination thereof.

11. The method of claim 1, wherein the ultrathin silver nanowires obtained in step (d) have a diameter of 30 nm or less and an aspect ratio of 300 or higher.

12. The method of claim 2, wherein the ultrathin silver nanowires obtained in step 4) have a diameter of 30 nm or less and an aspect ratio of 500 or higher.

13. The method of claim 2, wherein the magnetic ionic liquid containing tetrachloroferrate is composed of a compound represented by the following Chemical Formula 1, with tetrachloroferrate ($FeCl_4$) as an anionic ion:

[Chemical Formula 1]

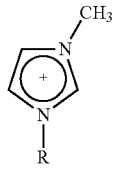

wherein R is hydrogen, an alkyl group of 1 to 15 carbon atoms, or an aromatic group.

14. The method of claim 13, wherein the magnetic ionic liquid of Chemical Formula 1 is composed of at least one compound selected from the group consisting of 1-butyl-3-methyl-imidazolinium tetrachloroferrate, 1-ethyl-3-methyl-imidazolinium tetrachloroferrate, and 1-propyl-3-methyl-imidazolinium tetrachloroferrate.

15. The method of claim 2, wherein the magnetic ionic liquid is used in an amount of 0.05 to 0.30 mol per mole of the silver salt.

16. The method of claim 1, further comprising dispersing or hybridizing the ultrathin silver nanowires with a one-dimensional polymer conductor to form a two-dimensional film consisting of the ultrathin silver nanowires and one-dimensional polymer conductor hybrid, wherein the one-dimensional polymer conductor is a conductive polythiol derivative, and is contained in an amount of at least 10 weight % in the transparent, conductive electrode film, and the transparent, conductive electrode film has a light transmittance of 80 to 98%, and a surface resistance of 5 ohm/□to 150 ohm/□.

* * * * *